US006711757B2

(12) United States Patent
Peck

(10) Patent No.: US 6,711,757 B2
(45) Date of Patent: Mar. 30, 2004

(54) PORTABLE FLUID DISPENSING DEVICE

(76) Inventor: Todd A. Peck, 46307 C.R. 55, Coshocton, OH (US) 43812

( * ) Notice: Subject to any disclaimer, the term of this patent is extended or adjusted under 35 U.S.C. 154(b) by 0 days.

(21) Appl. No.: 10/179,132

(22) Filed: Jun. 25, 2002

(65) Prior Publication Data

US 2003/0234265 A1 Dec. 25, 2003

(51) Int. Cl.[7] ..... A45D 19/04
(52) U.S. Cl. ..... 4/516; 4/644
(58) Field of Search ..... 4/516, 644, 515

(56) References Cited

U.S. PATENT DOCUMENTS

| | | | | |
|---|---|---|---|---|
| 2,962,728 A | | 12/1960 | Kuvin | 4/167 |
| 3,013,280 A | | 12/1961 | Coffman et al. | 4/159 |
| 3,983,583 A | | 10/1976 | Herman et al. | 4/167 |
| 4,660,233 A | * | 4/1987 | Beaver | 4/516 |
| 4,942,631 A | | 7/1990 | Rosa | 4/623 |
| 4,998,302 A | | 3/1991 | Silva | 4/516 |
| 5,305,481 A | | 4/1994 | Nebb | 4/516 |
| 5,465,438 A | | 11/1995 | Allman et al. | 4/626 |
| 5,526,539 A | | 6/1996 | Bower et al. | 4/516 |
| 6,173,458 B1 | | 1/2001 | Maddux | 4/626 |

FOREIGN PATENT DOCUMENTS

| | | |
|---|---|---|
| DE | 3911149 | 10/1990 |
| JP | 4332502 | 11/1992 |

* cited by examiner

*Primary Examiner*—Charles E. Phillips
(74) *Attorney, Agent, or Firm*—Kusner & Jaffe

(57) ABSTRACT

A portable fluid dispensing device suitable for convenient delivery of potable water. The portable fluid dispensing device includes a faucet and sink that can be conveniently located in close proximity to an individual located in a bed or chair. The sink is rotatable within a plane, and can be adjusted to a selected vertical height.

13 Claims, 5 Drawing Sheets

PORTABLE FLUID DISPENSING DEVICE

FIELD OF THE INVENTION

The present invention relates to a fluid supply device, and more particularly to a portable fluid dispensing device that can be conveniently located in proximity to an individual in a bed or chair.

BACKGROUND OF THE INVENTION

There are many environments in which a portable dispensing device for dispensing potable water can be used. These environments include, but are not limited to, hospitals, nursing homes, hospices, temporary military battlefield hospitals, and the like. In such environments there are often significant space limitations. Furthermore, the individuals using the portable dispensing device may have limited mobility or be bedridden. Accordingly, it may be necessary to adjust the height of the portable dispensing device. It may also be necessary for the portable dispensing device to be positioned in very close proximity to a patient in bed.

The present invention provides a portable fluid dispensing device which provides a convenient, flexible, and space-efficient system, that is particularly well suited to the above-mentioned environments.

SUMMARY OF THE INVENTION

In accordance with the present invention, there is provided a portable fluid dispensing device comprising a support assembly for supporting a source tank for providing a source of fluid, and a waste tank for storing waste fluid; a column mounted to the support assembly; a support member extending from the column; a basin module mounted to the support member, wherein said basin module is rotatable relative to the support member; a pump for drawing fluid from the source tank; and a faucet for dispensing the fluid.

It is an object of the present invention to provide a portable fluid dispensing device suitable for use from a bed or seated position.

It is another object of the present invention to provide a portable fluid dispensing device that can be rolled along a surface.

Another object of the present invention to provide a portable fluid dispensing device that can be vertically adjusted to a suitable height.

Another object of the present invention to provide a portable fluid dispensing device that can be horizontally adjusted to a suitable horizontal position.

Still another object of the present invention to provide a portable fluid dispensing device that has self-contained potable water and waste water tanks.

Still another object of the present invention to provide a portable fluid dispensing device that has self-contained heating unit to provide heated water.

Yet another object of the present invention to provide a portable fluid dispensing device that is simple and convenient to setup and operate.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE INVENTION

Figure 1:
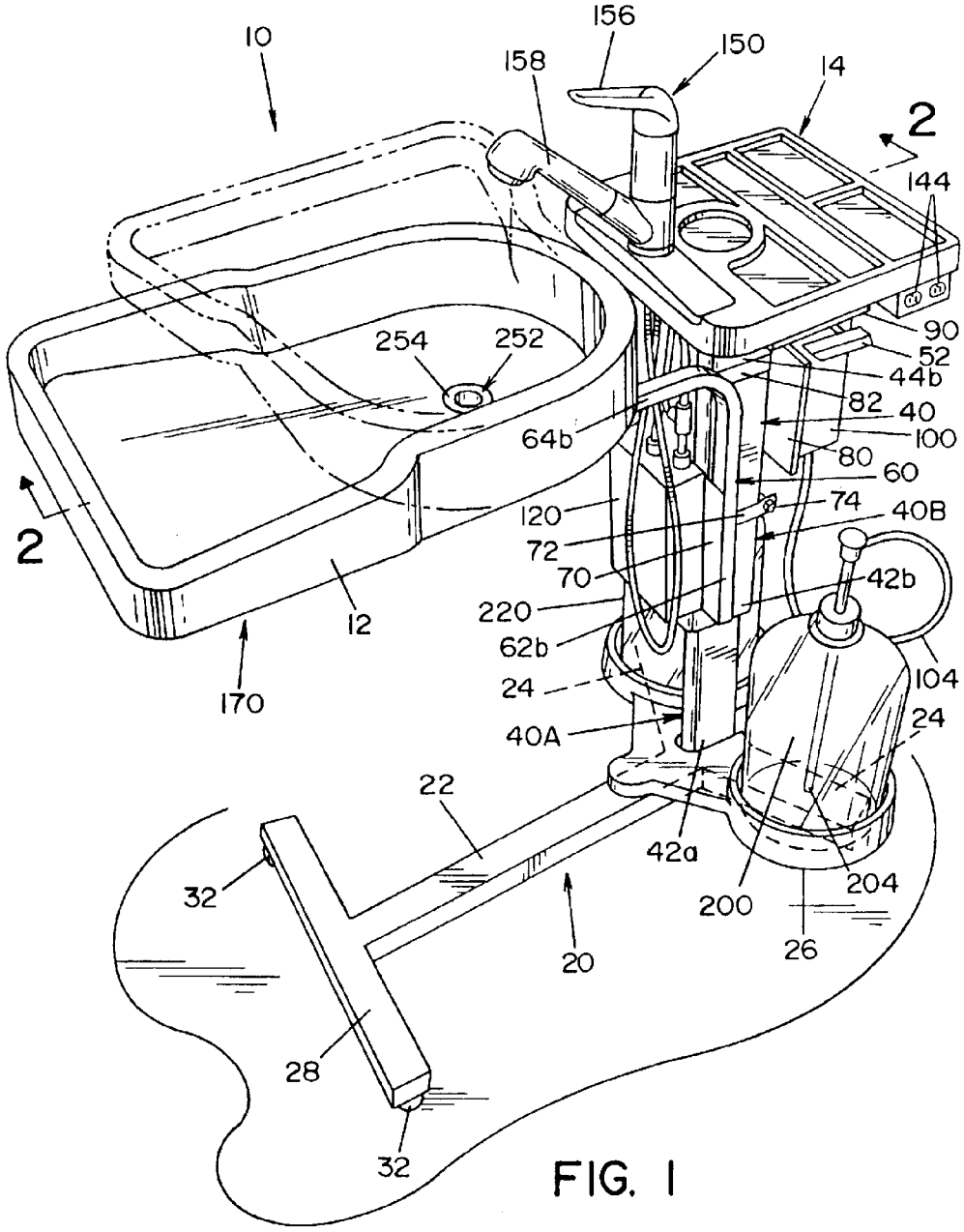
FIG. 1 is a perspective view of a portable fluid dispensing device according to a preferred embodiment of the present invention.

Referring now to the drawings wherein the showings are for the purpose of illustrating the preferred embodiment of the invention only, and not for the purpose of limiting same, FIG. 1 shows a portable fluid dispensing device 10 according to a preferred embodiment of the present invention. Portable fluid dispensing device 10 is generally comprised of a support assembly 20, a telescoping column 40, a support member 60, a pump 100, a heater 120, a faucet 150, a basin module 170 with associated sink body 12, a source tank 200 and a waste tank 220.

Support assembly 20 is generally comprised of a central member 22, and legs 24 and 28, forming an H-shaped configuration. Legs 24 and 28 extend outwardly from the ends of central member 22. Legs 24 support a holding base 26. Holding base 26 is dimensioned to receive source tank 200 and waste tank 220. In a preferred embodiment, central member 22 has a length in a range of 20 inches to 35 inches. Wheels 32 are located at the distal ends of legs 24, 28. In accordance with a preferred embodiment, wheels 32 are caster swivel wheels, with at least two wheels 32 having brakes. The brakes allow device 10 to be locked in a stationary position at a desired location. It should be appreciated that locating source tank 200 and waste tank 220 at the rear of support assembly 20 provides weight to counterbalance the weight of basin module 170.

It should be appreciated that support assembly 20 may take the form of alternative configurations, including but not limited to, a generally rectangular structure having wheels located at each comer thereof.

Telescoping column 40 is connected with support assembly 20 in the general vicinity of the intersection of central member 22 and legs 24. In a preferred embodiment of the present invention, column 40 is comprised of a first column section 40A and a second column section 40B. Column section 40A has a bottom end 42*a* and a top end (not shown), while column section 40B has a bottom end 42*b* and a top end 44*b*. Bottom end 42*a* of column section 40A is fixed to support assembly 20.

Column section 40A and column section 40B are preferably tubular pipe, wherein column section 40B has an internal dimension that is larger than the external dimension of column section 40A. This allows column section 40B to be raised and lowered relative to column section 40A.

A conventional electric motor drive 50, or alternatively a pneumatic piston, is mounted inside column section 40A and column section 40B to raise and lower column section 40B. A lever arm 52 is provided to activate the motor drive or pneumatic piston, to adjust the height of column 40. The implementation of the motor drive, pneumatic piston, and lever arm 52 will be apparent to one of ordinary skill in the art.

Support member 60 is attached to column section 40B for movement therewith. In this regard, adjustment of the height of column 40 will result in an adjustment in the height of support member 60. In a preferred embodiment, support member 60 is generally comprised of a pair of L-shaped brackets 60A, 60B. Bracket 60A has a vertical portion 62*a* and a horizontal portion 64*a*. Likewise, bracket 60B has a vertical portion 62*b* and a horizontal portion 64*b*. Preferably, brackets 60A and 60B are formed of conventional square or rectangular pipe.

Figure 4:
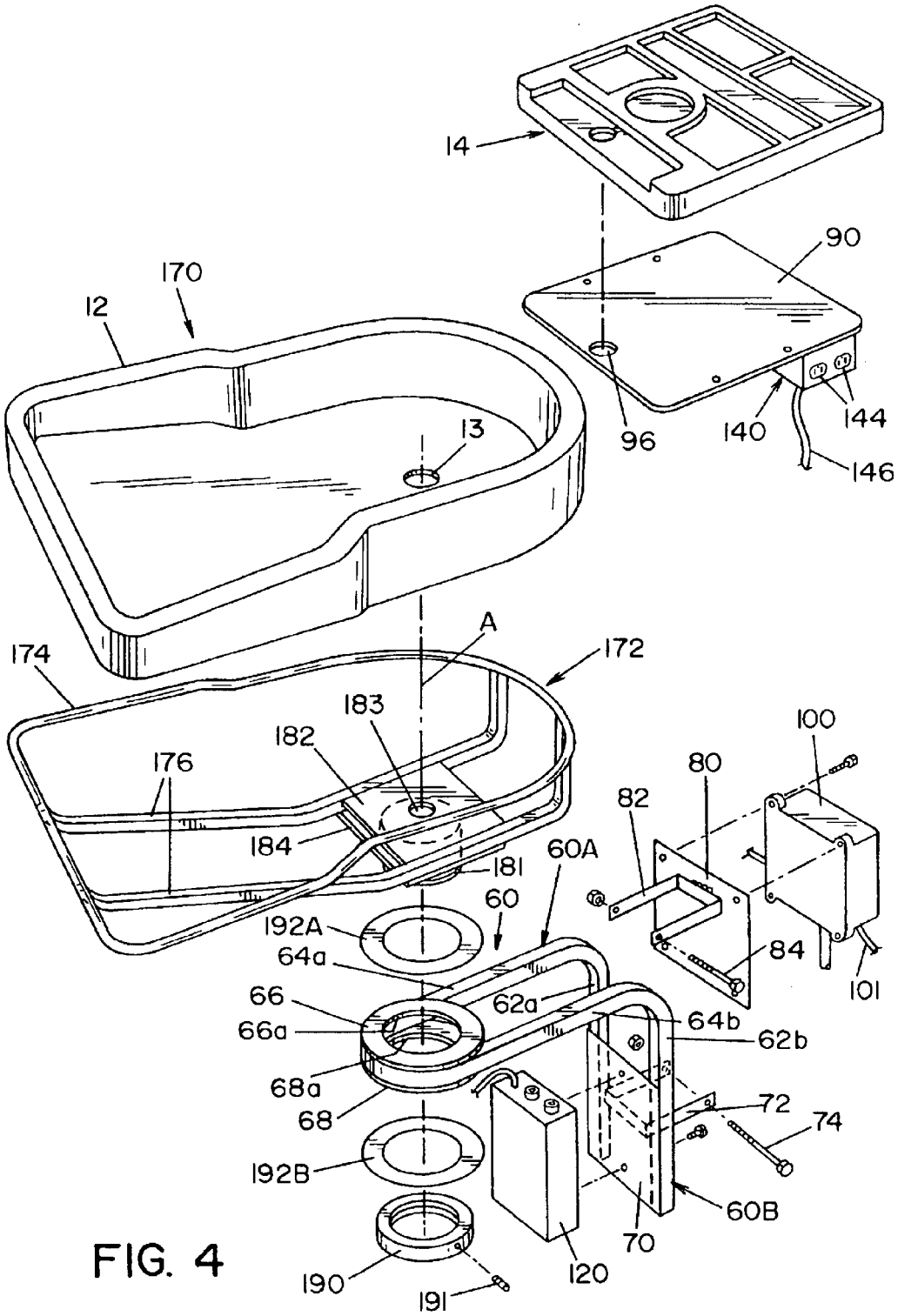
FIG. 4 is an exploded view of a portion of the portable fluid dispensing device.

Vertical portions 62*a* and 62*b* are joined together by a first mounting plate 70, as best shown in FIG. 4. In a preferred embodiment, mounting plate 70 is welded to vertical portions 62*a*, 62*b*. Mounting plate 70 provides a support surface for supporting a heater 120, which is described in detail below. In the embodiment shown, a metallic mounting strap 72 is welded to the back side of mounting plate 70. Mounting plate 70, together with brackets 60A, 60B, are attached to column section 40B. Fastening means 74 (e.g., bolt, lock washer, and nut) secure mounting strap 72 to column section 40B.

Horizontal portions 64*a*, 64*b* of brackets 60A, 60B provide a support structure for basin module 170 (as best shown in FIG. 4), which is described in detail below. Horizontal portions 64*a* and 64*b* are joined together by a pair of locating rings 66 and 68. Upper locating ring 66 is preferably welded to the top surface of horizontal portions 64*a*, 64*b*, while lower locating ring 68 is preferably welded to the bottom surface of horizontal portions 64*a*, 64*b*. Openings 66*a* and 68*a* of locating rings 66, 68 are dimensioned to receive threaded pipe 181 of basin module 170, as will be described in detail below.

Figure 2:
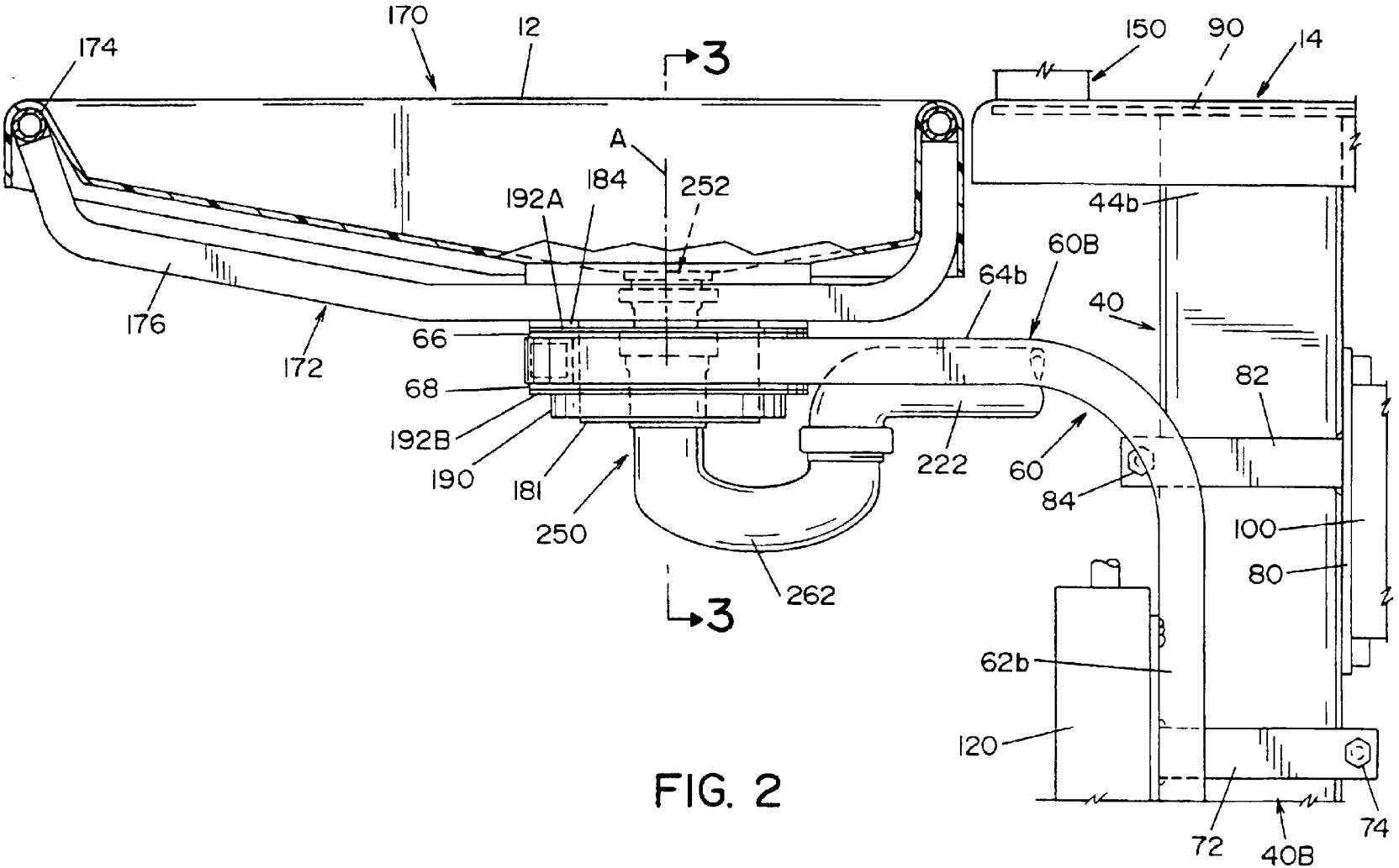
FIG. 2 is a sectional view of the portable fluid dispensing device, taken along line 2—2 of FIG. 1.

A second mounting plate 80 is attached to column section 40B of column 40, as best shown in FIG. 2. Mounting plate 80 provides a support surface for supporting pump 100, which is described in detail below. A metallic mounting strap 82 is welded to the back side of mounting plate 80. Mounting plate 80 is attached to column section 40B of column 40. Fastening means 84 (e.g., bolt, lock washer, and nut) secure mounting strap 82 to column section 40B.

A third mounting plate 90 is attached to top end 44*b* of column section 40B, as best shown in FIG. 4. In the embodiment shown, mounting plate 90 is welded to top end 44*b* of column section 40B. Mounting plate 90 provides a support surface for a power switch box 140, a faucet 150 and a shelf 14, all of which are described in further detail below. A hole 96 is formed in mounting plate 90 to receive faucet 150.

Basin module 170 is generally comprised of a saddle 172, a mounting assembly, a drain 250, and a sink body 12. Saddle 172 is comprised of a frame 174 having tubular two support members 176. Frame 174 is dimensioned to receive and support sink body 12. In a preferred embodiment, sink body 12 is press fit to saddle 172. Support members 176 provide structural strength to saddle 172, and support the mounting assembly. Basin module 170 is preferably located above, and generally parallel to support assembly 20, so as to provide a gap therebetween.

Figure 3:
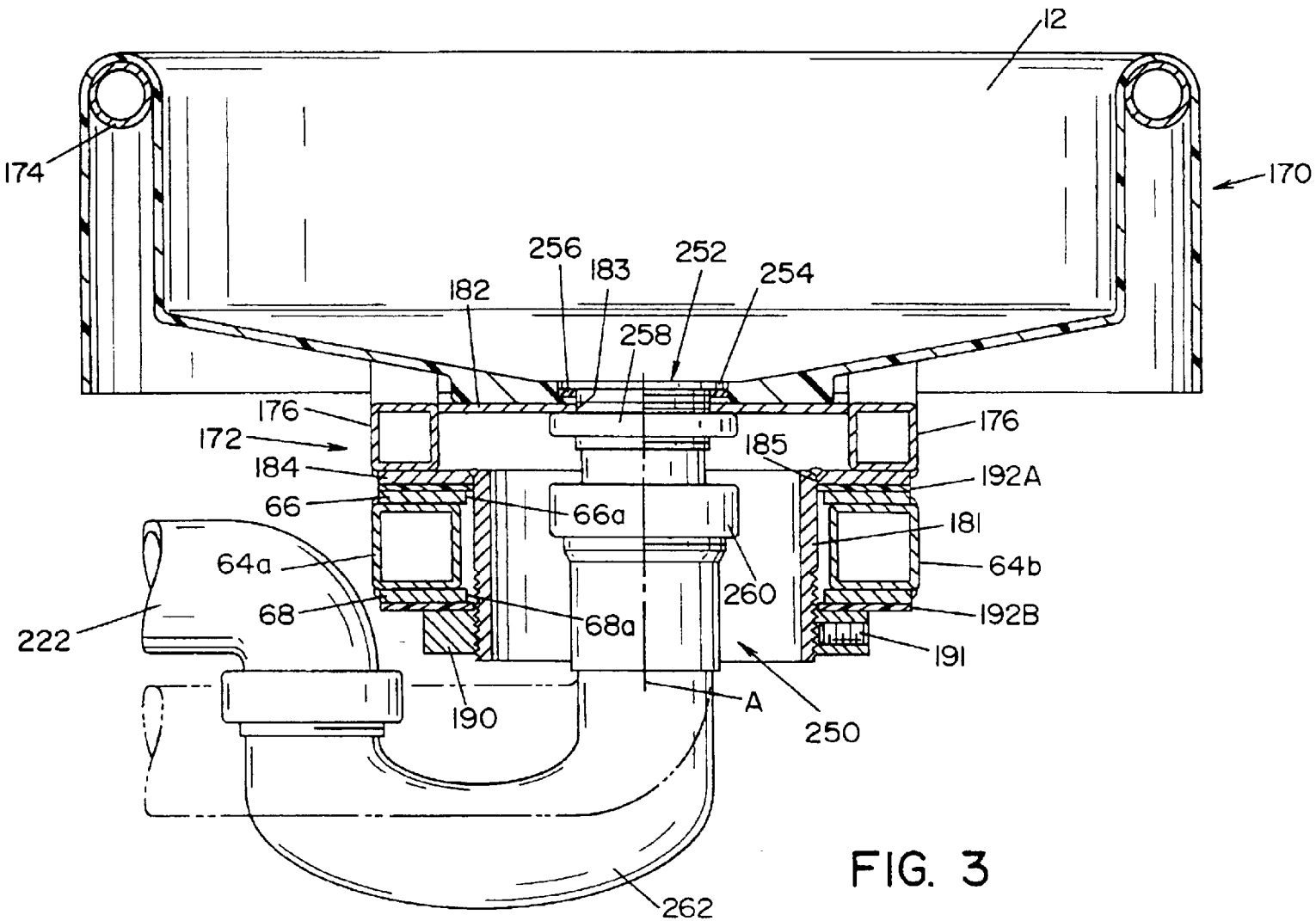
FIG. 3 is a sectional view of the portable fluid dispensing device, taken along line 3—3 of FIG. 2.

The mounting assembly, best seen in FIG. 3, is generally comprised of spaced apart mounting plates 182 and 184, and threaded pipe 181. Mounting plate 182 is located between support members 176, and is welded thereto. Mounting plate 184 is welded to the lower surface of support members 176. Mounting plate 182 includes an opening 183 dimensioned to receive drain 250, which is described below. Mounting plate 184 includes an opening 185 dimensioned to receive threaded pipe 181. In this regard, threaded pipe 181 extends through opening 185 of mounting plate 184, and is welded to mounting plate 184. Basin module 170 is attached to support member 60 by means of threaded pipe 181. Threaded pipe 181 is aligned along an axis A, about which basin module 170 can swivel. Frame 174 and support members 176 are preferably formed of ½ inch conduit or ¾ inch box tubing, but may also take the form of lightweight tubular plastic materials.

Drain 250 preferably takes the form of a conventional pop-up sink drain assembly, well known to those skilled in the art. With reference to FIGS. 2 and 3, drain 250 includes a drain body 252, an O-ring 256, a metal ring 258, a nut 260, and a drain trap 262. Drain body 252 is mounted in drain opening 13 of sink body 12, and extends through opening 183 of mounting plate 182, and opening 185 of mounting plate 184. Drain body 252 includes a flange 254 that is located adjacent to the top surface of sink body 12. O-ring 256 is located adjacent to sink body 12. Nut 258 is located below O-ring 256. Nut 258 engages with threads formed on the outer surface of drain body 252, to secure drain body 252 to sink body 12. Nut 260 is adjusted to allow basin module 170 to rotate relative to drain 250. Drain trap 262 is connected to the lower end of drain body 252 by nut 260. A conduit 222 is connected between drain trap 262 and waste tank 220. It should be understood that a flexible hose (shown in phantom in FIG. 3) may be substituted for drain trap 262 and conduit 222.

Basin module 170 is mounted to support member 60 by inserting threaded pipe 181 through both upper locating ring 66 and lower locating ring 68. A threaded locking collar 190 is threadingly engaged with the end of threaded pipe 181 extending through lower locating ring 68. Set screws 191 may be used to fix locking collar 190 to threaded pipe 181. In a preferred embodiment, a Teflon washer 192A is located between upper locating ring 66 and mounting plate 184, and a Teflon washer 192B is located between lower locating ring 68 and locking collar 190. Teflon washers 192A, 192B facilitate relative rotational movement between basin module 170 and support member 60. In a preferred embodiment, basin module 170 is movable 180 degrees about the longitudinal axis defined by threaded pipe 181.

Figure 5:
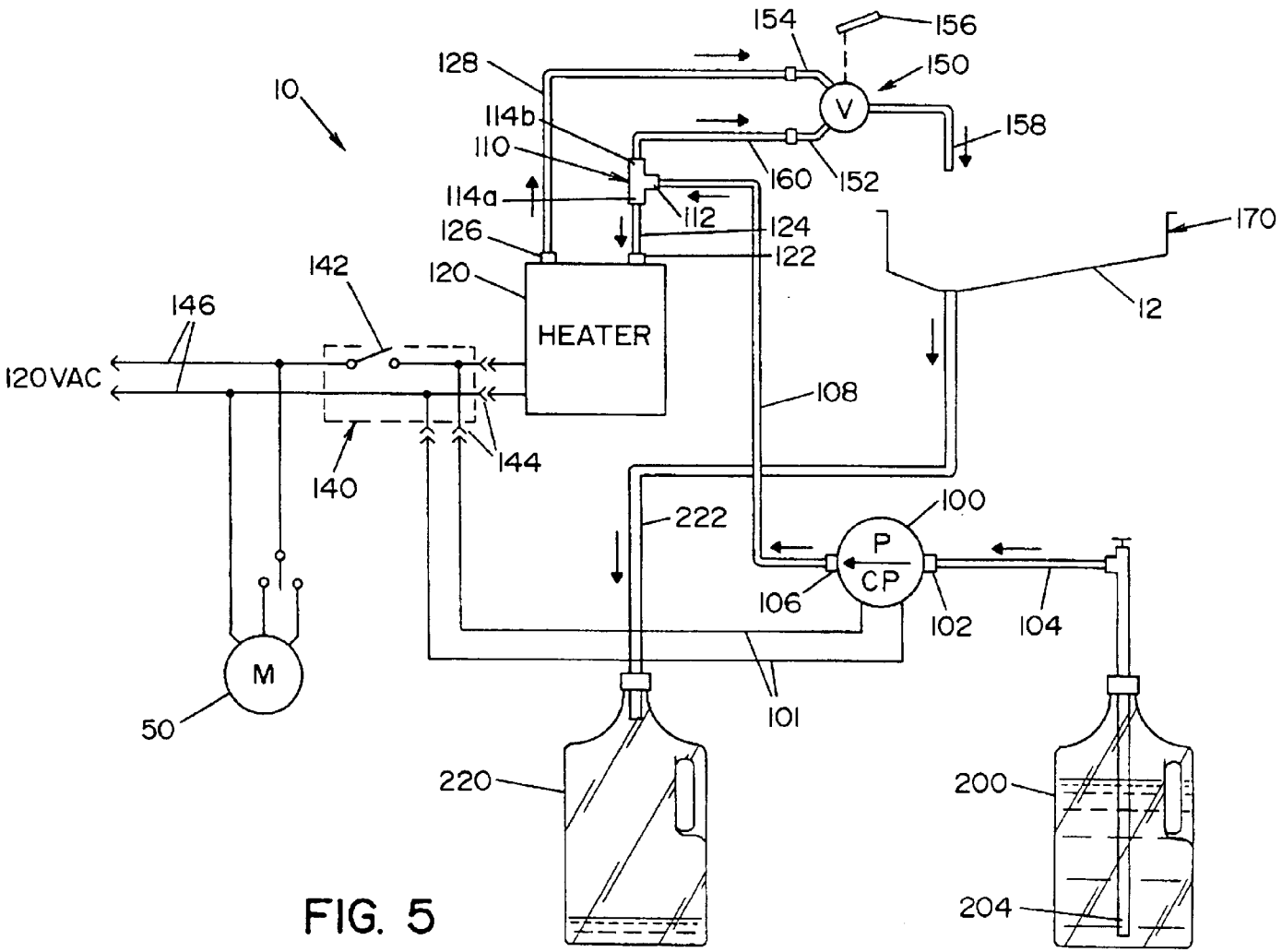
FIG. 5 is a schematic view of the portable fluid dispensing device, illustrating the operation thereof.

Referring now to FIGS. 1 and 5, pump 100 includes an input port 102, an output port 106 and a power cord 101. A conduit 104 connects input port 102 with a first tank 200, described in further detail below. A conduit 108 connects output port 106 with T-fitting 110. T-fitting 110 includes an input port 112, a first output port 114*a* and a second output port 114*b*. Conduit 108 is connecting with input port 112. In a preferred embodiment, pump 100 takes the form of a FLOWJET water pump (BW series). The FLOWJET water pump has a flow rate up to 1.0 GPM (3.8 L/min), and an operating pressure up to 30 PSI (2.1 bar). This pump also includes a float switch for automatic shut-off when there is no fluid to be pumped, a check valve to prevent back flow, and a compact housing. As indicated above, pump 100 is mounted to second mounting plate 80.

Heater 120 heats water supplied to faucet 150. Heater 120 includes an input port 122 and an output port 126. Input port 122 receives unheated water. A conduit 124 connects input port 122 with output port 114*a* of T-fitting 110. Output port 126 supplies heated water to faucet 150. A conduit 128 connects output port 126 with faucet 150. In a preferred embodiment, heater 120 takes the form of an EEMAX water heater (model SP2412). As indicated above, heater 120 is mounted to first mounting plate 70.

Power switch box 140 is generally comprised of a switch 142, one or more electrical outlets 144 and a power cord 146. Power cord 146 is used to connect power switch box 140 with an external power source, such as 120 volt AC power. Electrical outlets 144 provide connecting receptacles for pump 100 and heater 120. Switch 142 switches power to electrical outlets 144. As indicated above, power switch box 140 is mounted to third mounting plate 90. It should be appreciated that a suitable portable battery power source may be substituted for the external power source.

Faucet 150 preferably takes the form of a conventional single handle faucet. In this regard, faucet 150 includes a cold line-in 152, a hot line-in 154, a single-handle valve control 156, and a detachable nozzle 158. As indicated above, faucet 150 is mounted to third mounting plate 90. A conduit 160 connects cold line-in 152 with second output port 114*b* of T-fitting 110. Conduit 128 connects hot line-in 154 with output port 126 of heater 120.

As indicated above, a shelf 14 is also mounted to third mounting plate 90. Shelf 14 provides a surface for storing items such as soap, washcloths, and other accessories.

Source tank 200 provides a supply of potable water. A tube 204 extends into source tank 200 to facilitate withdrawal of water therefrom. As indicated above, a conduit 104 connects source tank 200 with pump 100.

Operation of portable fluid dispensing device 10 will now be described in detail with particular reference to FIGS. 1 and 5. First, source tank 200 is filled with potable water, while any waste water is emptied from waste tank 220. Device 10 is then moved to a desired location. Wheels 32 facilitate movement of device 10.

Telescoping column 40 is adjusted to a desired height by operating lever arm 52 to activate motor drive 50, or alternatively a pneumatic piston. Basin module 170 is rotated to a desired position to facilitate use of device 10. As indicated above, basin module 170 is rotatable 180 degrees. It should be appreciated that a sufficient gap is provided between the horizontal portions 64*a*, 64*b* of support member 60 and support assembly 20, to allow basin module 170 to be located over the top of a bed. In this regard, support assembly 20 is rolled under a bed to locate basin module 170 over the top side of the bed. As noted above, basin module 170 may be rotated to further locate basin module 170 in a convenient position.

Power cord 146 is connected with an appropriate electrical outlet, and switch 142 is located in an ON position to supply power to pump 100 and heater 120. Activation of pump 100 causes water to be drawn from source tank 200 through tube 204 and conduit 104. Water enters pump 100 through input port 102. Water exits pump 100 through output port 106, and travels through conduit 108 to T-fitting 110.

Water exits T-fitting 110 through first output port 114*a* and second output port 114*b*. The water exiting first output port 114*a* travels through conduit 124 to input port 122 of heater 120. This water will be heated before reaching faucet 150. The water exiting second output port 114*b* travels through conduit 160 to cold line-in 152 of faucet 150.

Heater 120 heats the water received at input port 122 to a desired temperature. Heated water exits heater 120 through output port 126, and travels through conduit 128 to hot line-in 154 of faucet 150.

When the faucet handle valve control 156 is operated to open the faucet valve, potable water is released from the nozzle 158. The temperature of the released water is determined by the position of faucet handle valve control 156, as is conventional with single handle faucets.

Water released into sink body 12 travels down drain body 252, through drain trap 262 and conduit 222, and into waste tank 220.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A portable fluid dispensing device, comprising:

a support assembly for supporting a source tank for providing a source of fluid, and a waste tank for storing waste fluid;

a column mounted to the support assembly;

a support member extending from the column;

a basin module mounted to the support member and including a sink body with a drain opening having a first axis, wherein said basin module is rotatable relative to the support member about an axis generally co-linear with said first axis;

a pump for drawing fluid from the source tank; and a faucet for dispensing the fluid.

2. A portable fluid dispensing device according to claim 1, wherein said column is telescoping.

3. A portable fluid dispensing device according to claim 1, wherein said basin module is rotatable 180 degrees.

4. A portable fluid dispensing device according to claim 1, wherein said basin module includes:

a saddle;

a sink body connected with the saddle;

a mounting assembly connected with the saddle to mount said basin module to said support member; and a drain for removing fluid from the sink body.

5. A portable fluid dispensing device according to claim 4, wherein said drain is in communication with said waste tank.

6. A portable fluid dispensing device according to claim 1, wherein said device includes a heating means for heating fluid drawn out of the source tank by said pump means.

7. A portable fluid dispensing device according to claim 1, wherein said basin module is located above and generally parallel to said support assembly.

8. A portable fluid dispensing device, comprising:

a support assembly for supporting a source tank for providing a source of fluid, and a waste tank for storing waste fluid;

a column mounted to the support assembly;

a support member extending from the column;

a basin module mounted to the support member, wherein said basin module is rotatable relative to the support member, said basin module including:

a saddle, a sink body connected with the saddle, a mounting assembly connected with the saddle to mount said basin module to said support member, and a drain for removing fluid from the sink body;

a pump for drawing fluid from the source tank; and a faucet for dispensing the fluid.

9. A portable fluid dispensing device according to claim 8, wherein said column is telescoping.

10. A portable fluid dispensing device according to claim 8, wherein said basin module is rotatable 180 degrees.

11. A portable fluid dispensing device according to claim 8, wherein said drain is in communication with said waste tank.

12. A portable fluid dispensing device according to claim 8, wherein said device includes a heating means for heating fluid drawn out of the source tank by said pump means.

13. A portable fluid dispensing device according to claim 8, wherein said basin module is located above and generally parallel to said support assembly.

* * * * *